United States Patent [19]

Rotter et al.

[11] Patent Number: 4,866,866

[45] Date of Patent: Sep. 19, 1989

[54] COLLAPSIBLE SIGN

[76] Inventors: Bernard J. Rotter, 9001 Chesshire La., Maple Grove, Minn. 55369; Timothy M. Whitten, 8980 Neill Lake Rd., Eden Prairie, Minn. 55344; Silas A. Brown, Marine on the St. Croix, P.O. Box 86, St. Croix, Minn. 55047

[21] Appl. No.: 118,172

[22] Filed: Nov. 9, 1987

[51] Int. Cl.[4] ..... G09F 15/00

[52] U.S. Cl. ..... 40/610; 40/603

[58] Field of Search ..... 40/603, 604, 606, 607, 40/610, 617, 155, 152; 248/166, 171, 188.1, 97, 156, 409, 410; 211/190; 160/351, 378, 377, 373, 327, 328, 349 R, 349 D, 267.1, 277

[56] References Cited

U.S. PATENT DOCUMENTS

| | | | |
|---|---|---|---|
| 566,815 | 9/1896 | Taylor | 160/327 |
| 1,406,916 | 2/1922 | Arnold | 40/606 |
| 1,638,193 | 8/1927 | Forwood | 40/606 |
| 2,532,837 | 12/1950 | DePuy | 160/377 |
| 3,097,014 | 7/1963 | Francis | 160/328 |
| 3,213,824 | 10/1965 | Jenkins | 248/156 |
| 3,603,540 | 9/1971 | Gouge | 248/156 |
| 3,979,846 | 9/1976 | Euzarraga | 40/155 |
| 4,103,445 | 8/1978 | Smith et al. | 40/610 |
| 4,368,586 | 1/1983 | Forzelias | 40/604 |
| 4,636,109 | 1/1987 | Clausen et al. | 248/156 |

*Primary Examiner*—Robert P. Swiatek
*Assistant Examiner*—J. R. Hakomaki
*Attorney, Agent, or Firm*—James V. Harmon

[57] ABSTRACT

A collapsible portable sign is described having a pair of vertically disposed parallel laterally spaced apart legs connected together at their upper ends by means of a center piece, all of which can be formed from metal or plastic tubing. The legs are releasably connected to the center piece as by means of pivots or removable socket connections enabling the legs to be folded parallel to the center piece for compact storage. A movable support bar extends between the legs when the sign is erect and a flexible sheet of cloth (e.g., nylon cloth) or plastic is supported between the center piece and the support bar to provide a display surface having information printed thereon.

5 Claims, 2 Drawing Sheets

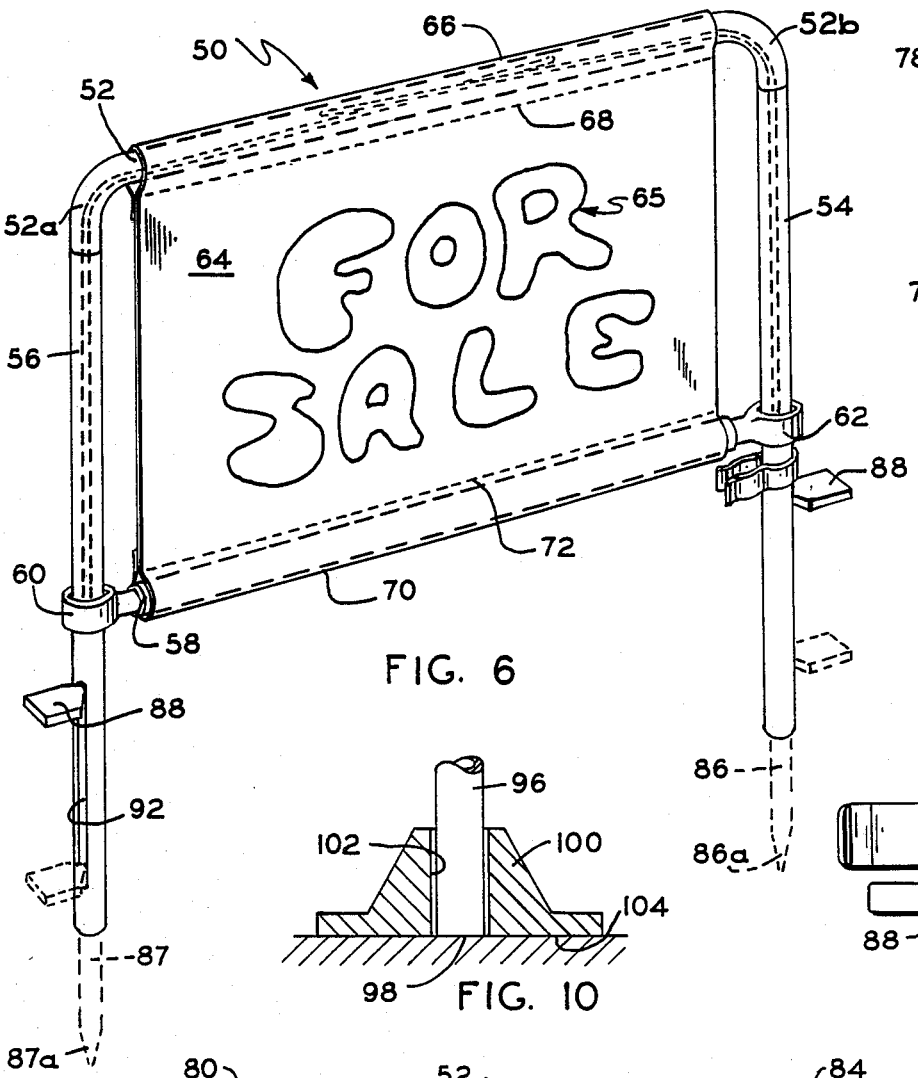
FIG. 6
FIG. 10
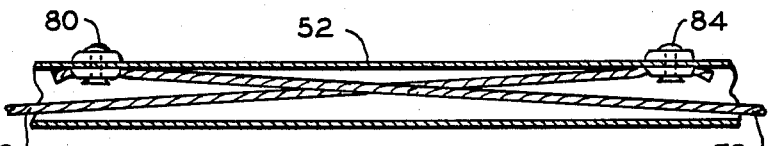
FIG. 8
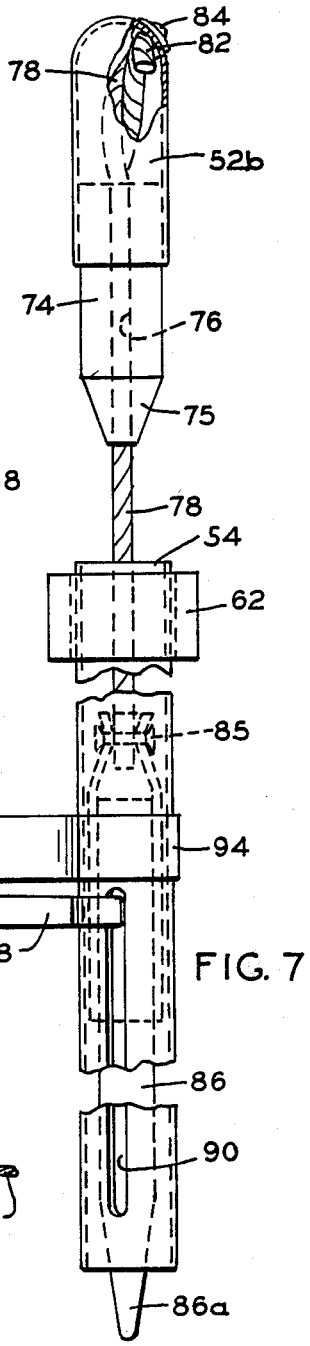
FIG. 7
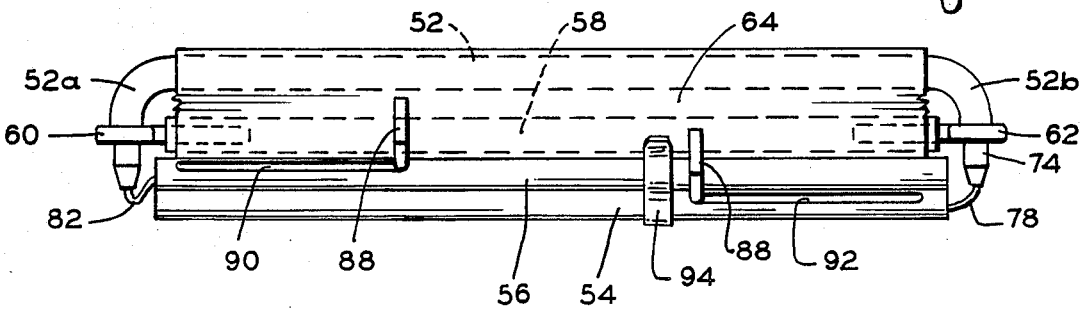
FIG. 9

COLLAPSIBLE SIGN

FIELD OF THE INVENTION

The present invention relates to signs and more particularly to portable signs that can be collapsed for transportation and storage.

BACKGROUND OF THE INVENTION

A number of collapsible signs have been previously proposed. For example it has been proposed to provide a sign having a Y-shaped frame with a pair of inclined frame members used to support a flexible sheet between them. These signs, however, because they are supported from a single support post, tend to be easily tipped over and the unusual shape of the sign is not satisfactory for some applications. Other portable collapsible signs have additional problems. Some are only partially collapsible, others lack adequate support for the display surface or require a display surface formed from a special material such as a plastic composition which is not readily available.

In view of these and other deficiencies of the prior art it is a general object of the present invention to provide an improved collapsible sign and more particularly a portable sign which is low in cost, rugged in construction, reliable in operation and which can be collapsed to a small size for transportation and storage. A further object is to provide a collapsible sign that can be used for a variety of purposes, as by real estate agents to serve as a FOR SALE sign suited for temporary placement in front of a home or building to indicate that the building is for sale or to indicate the direction of a home for sale. For such applications the invention provides a lightweight and inexpensive FOR SALE sign that can be easily carried under one arm and in practice weighs about five pounds. Several such signs can be easily stored in a collapsed form in an automobile trunk and easily and quickly erected when the salesman arrives at the property. They are particularly appreciated by a salesperson who is small in stature and is not used to carrying and installing the heavy and bulky FOR SALE and OPEN HOUSE signs that are now in common use.

Other more detailed and specific objects of the present invention will be apparent in view of the following specification which sets forth by way of example but a few of the various forms of the invention within the scope of the appended claims.

SUMMARY OF THE INVENTION

The invention provides a collapsible sign having a U-shaped frame including two laterally spaced, vertically disposed legs which are connected when the sign is erect at their upper ends to a horizontally disposed center piece. The center piece is releasably secured between the legs, e.g., by means of a pivot or a socket connection allowing the legs to be placed parallel to the center piece. A moveable support bar extends between the legs below the center piece when the sign is erect. A flexible display sheet is supported between the center piece and the bar to provide a display surface having information thereon such as the words "FOR SALE". In this way the sign can be collapsed by moving the bar toward the center piece and by placing the legs adjacent to the center piece and parallel thereto. This enables the display sheet to be folded or, if desired, wrapped around the upper and lower horizontal frame members as the sign is collapsed for compact storage.

THE FIGURES

FIG. 6 is a perspective view of another form of the invention.

FIG. 7 is an end view of the sign of FIG. 6 on an enlarged scale.

FIG. 8 is a partial longitudinal sectional view of the center piece.

FIG. 9 is a side elevational view of the sign of FIGS. 6–8 when collapsed and FIG. 10 is a vertical sectional view of a modified form of supporting stand for the invention.

DESCRIPTION OF A PREFERRED EMBODIMENT

Figure 1:
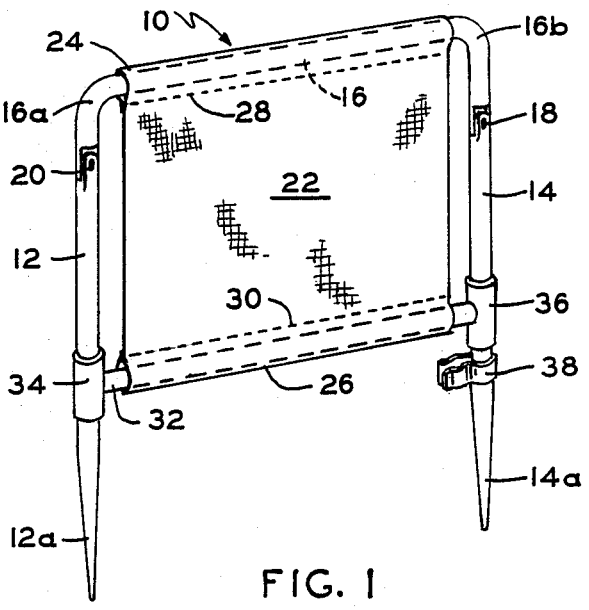
FIG. 1 is a perspective view of one form of the invention when erect.
Figure 2:
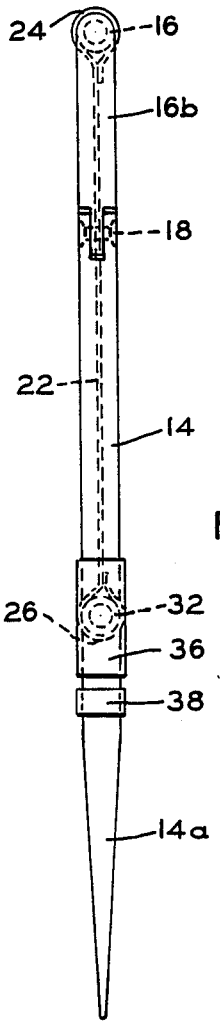
FIG. 2 is an end view of FIG. 1 on an enlarged scale.

Refer now to FIG. 1 which illustrates a collapsible sign 10 having a pair of vertically disposed laterally spaced apart legs 12 and 14 formed from metal tubing or plastic and connected to a center piece 16 by means of hinges 18 and 20. The center piece 16 has downwardly depending end pieces **16*a* and 16*b* which terminate in the hinges 18 and 20. Extending downwardly from the center piece 16 is a display surface comprising a flexible sheet such as a nylon cloth or plastic sheet 22. Sheet 22 is held in place by being folded over the center piece 16 at 24 and secured to itself by means of a hem 28. Similarly, the lower end is folded at 26 around a support bar 32 and is secured to itself by means of a hem 30. In this way the display surface 22 is secured at its upper and lower ends to the center piece 16 and the support bar 32**, respectively.

Figure 4:
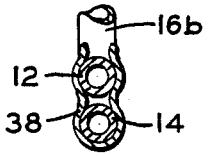
FIG. 4 is a vertical sectional view taken on line 4—4 of FIG. of 3.
Figure 3:
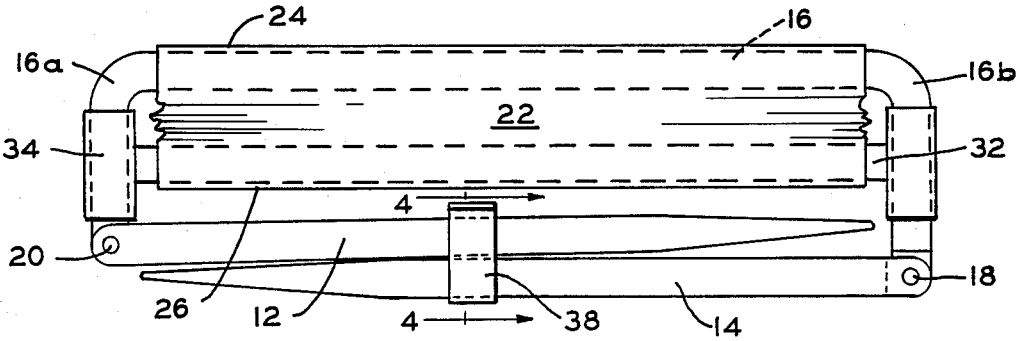
FIG. 3 is a side elevational view of the sign in a collapsed condition.

The support bar 32 is provided with vertically disposed sleeves 34 and 36 at its ends which are slidably engaged over the legs 12 and 14. When the sign 10 is to be collapsed and placed in storage, the support bar 32 is slid upwardly on the legs above the pivots 18 and 20 onto the terminal portions **16*a* and 16*b* of center piece 16 so that the legs can be folded centrally as shown in FIG. 3 to a collapsed condition adjacent and parallel to the center piece 16. A U-shaped clamp 38 formed from spring steel or other suitable material is mounted upon the leg 14 and includes parallel arm portions adapted to snap over the leg 12 to hold the sign in a collapsed condition as shown in FIGS. 3 and 4**.

Figure 5:
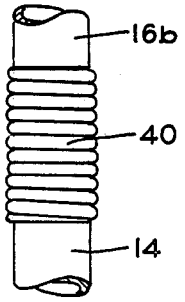
FIG. 5 is a partial side elevational view of a modified form of connection between the legs and center piece.

The pivots 18 and 20 can, if desired, be replaced by a spring 40 connecting the center piece 16 to each of the legs as shown in FIG. 5. Both the hinges 18 and 20 and the spring 40 can be thought of as a releasable connection between the legs and the center piece allowing the legs to be shifted to the collapsed condition of FIG. 3.

Refer now to FIGS. 6–9 which illustrate another embodiment of the invention. In this form of the invention, a collapsible sign 50 is formed from a horizontally disposed center piece 52 having vertically disposed laterally spaced legs 54 and 56 at opposite ends projecting downwardly from vertically disposed downwardly extending terminal portions **52*a* and 52*b*. The frame composed of the legs and center piece 52 can be formed from various materials but aluminum tubing is suitable for most applications. Extending between the legs 54 and 56 is a support bar 58 having a sleeve or ring 60 and 62 at each end adapted to slide vertically on the legs 54 and 56. A display surface defined by a flexible sheet 64 is connected between the center piece 52 and the support bar 58. The sheet 64 can be attached in any convenient way by wrapping its upper end at 66 around the bar 52 and securing it to itself by means of a seam 68. Similarly, the lower edge of the display surface 64 is wrapped at 70 around the support bar 58 and secured to itself by seam 72. In a typical application the display surface 64 is provided with printed information such as the words "FOR SALE" at 65**.

Projecting downwardly from the lower ends of the each of the terminal portions 52*a* and 52*b* and rigidly connected to them are plugs 74 having tapered lower end portions 75 adapted to slide within the upper open ends of the hollow tubular legs 54 and 56. The legs 54 and 56 are of the proper size to slide easily onto the exposed ends of the plugs 74. In this way, the legs 54, 56 are releasably connected to the ends of the center piece 52. Each of the plugs 74 has a central vertical bore 76 for purposes which will be described below.

Within the legs 54, 56 are slidably mounted support stakes 86 and 87, respectively, each having a horizontally disposed foot pedal 88 extending laterally through vertical slots 90, 92 in the legs. In this way the stakes 86, 87 can be forced into the ground by applying foot pressure to the pedals 88. When the sign is to be removed and collapsed for storage, the support stakes 86, 87 are withdrawn into the legs 54, 56 by means of elastic cords, e.g., bungee cords, 78 and 82 which are secured at their upper ends to the center piece 52 by means of fasteners 80, 84 and at their lower ends to one of the stakes 86, 87, for example as shown at 85 in FIG. 7. To provide sufficient length and elasticity it is convenient to have the elastic cords 78, 82 cross each other within the center piece 52 as shown in FIG. 8.

Once the stakes 86, 87 have been retracted by the elastic cords 78, 82 to the position of FIG. 7 and the support bar 58 has been raised so that the sleeves 60, 62 fit over the terminal portions 52*a* and 52*b* of the center piece 52, the legs 54, 56 can be separated from the center piece 52 by sliding them off the plugs 74. The sign can then be collapsed as shown in FIG. 9. A clamp 94 similar to the clamp 38 already described will hold the legs 54, 56 in a collapsed position parallel to the center piece 52 and adjacent to it. The display surface 64 folds up with a number of transversely extending accordian folds as shown in FIG. 9 or, if desired, it can be wrapped around the upper and lower horizontal frame members.

Refer now to FIG. 10 which illustrates a modified form of support for the legs 54, 56. In place of the stakes 86 and 87, one of the legs which is designated 96 in this case is placed within a vertical socket in a support stand 100 having a flat bottom 104 which rests on the ground. If the stands 100 are used, the stakes 86, 87 and associated elastic bands 78, 82 will not be needed.

Many variations of the present invention within the scope of the appended claims will be apparent to those skilled in the art once the principles described above are understood.

What is claimed is:

1. A collapsible sign having a U-shaped tubular frame including two laterally spaced vertically disposed tubular legs connected together when the sign is in an erect condition at the upper ends thereof by means of a horizontal center tubular piece, said center piece having a horizontal tubular portion and two downwardly extending parallel vertically disposed hollow terminal portions that comprise downwardly directed ends of the center piece, each leg being releasably connected to one of the hollow terminal portions that comprise the downwardly directed ends of the center piece, said releasable connections comprising a socket connection between the lower end of each of the terminal portions and the upper end of each leg, each said socket connection enabling each of the legs to be slid off of and disconnected from the terminal portions of the center piece whereby each leg can be folded to a collapsed condition, a support bar extending between the legs when the sign is erect and said support bar having a sleeve or ring at each end slidably engaged over one of the legs, a display sheet formed from flexible material supported between the center piece and the support bar to provide a display surface for information where the sign can be collapsed by moving the support bar toward the center piece, by disconnecting said socket connections and by placing the legs adjacent to the center piece to thereby enable the display sheet to be folded or wrapped as the sign is collapsed for compact storage, each of the legs is provided with a vertically disposed mounting stake slidably associated therewith and a pressure applying member for exerting a downward force to the stake to force the stake into the ground while the lower end of the leg rests adjacent to the surface of the ground, each of said stakes is an elongated member slidably supported at the lower end of one of the legs and a dual purpose elongated resilient member is connected between the horizontal piece and the stake for yieldably biasing each stake in an upward direction to a retracted position at the lower end of each leg and each elongated resilient member also yieldably biases one of the socket connections toward an engaged condition to maintain the collapsible sign in an assembled state.

2. The apparatus of claim 1 wherein the pressure applying member is a foot pedal, the stake is mounted within the leg, a slot is provided in each of the legs and the foot pedal extends from the stake through the slot enabling the user to apply foot pressure to each stake to force each stake into the ground as the resilient member is stretched.

3. The apparatus of claim 1 wherein the resilient member is an elongated bungee cord affixed at its lower end to the upper end of the stake and at its upper end to a portion of the horizontal piece between the hollow terminal downwardly directed end portions.

4. The sign of claim 1 wherein clamp means are provided for operative association between a portion of the sign and at least one of the legs for releasibly clamping the legs in a compact collapsed condition parallel to the center piece.

5. The sign of claim 1 wherein each of the socket connections includes a plug mounted within one of the terminal portions of the center piece and extending downwardly therefrom, each such plug is adapted to slide into an open upper end of one of said legs.

* * * * *